US011255051B2

(12) United States Patent
Calewarts et al.

(10) Patent No.: US 11,255,051 B2
(45) Date of Patent: Feb. 22, 2022

(54) FIBROUS SHEET WITH IMPROVED PROPERTIES

(71) Applicant: KIMBERLY-CLARK WORLDWIDE, INC., Neenah, WI (US)

(72) Inventors: Deborah J. Calewarts, Winneconne, WI (US); Jian Qin, Appleton, WI (US); Charles W. Colman, Marietta, GA (US); Cathleen M. Uttecht, Menasha, WI (US); Donald E. Waldroup, Roswell, GA (US); Francis P. Abuto, Johns Creek, GA (US); Jenny L. Day, Woodstock, GA (US); Stephen M. Lindsay, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 16/767,614

(22) PCT Filed: Nov. 29, 2017

(86) PCT No.: PCT/US2017/063653
§ 371 (c)(1),
(2) Date: May 28, 2020

(87) PCT Pub. No.: WO2019/108172
PCT Pub. Date: Jun. 6, 2019

(65) Prior Publication Data

US 2020/0370246 A1 Nov. 26, 2020

(51) Int. Cl.

| | |
|---|---|
| ***D21H 27/38*** | (2006.01) |
| ***D04H 1/425*** | (2012.01) |
| ***D04H 1/593*** | (2012.01) |
| ***D21F 11/00*** | (2006.01) |
| ***D21F 11/02*** | (2006.01) |
| ***D21H 13/24*** | (2006.01) |
| ***D21H 15/04*** | (2006.01) |
| ***D21H 17/35*** | (2006.01) |
| ***D21H 21/16*** | (2006.01) |
| ***D04H 1/541*** | (2012.01) |
| ***D04H 1/4374*** | (2012.01) |
| ***D04H 1/559*** | (2012.01) |
| ***D04H 1/732*** | (2012.01) |

(52) U.S. Cl.
CPC ..... *D21H 27/38* (2013.01); *D04H 1/425* (2013.01); *D04H 1/4374* (2013.01); *D04H 1/5412* (2020.05); *D04H 1/559* (2013.01); *D04H 1/593* (2013.01); *D04H 1/732* (2013.01); *D21F 11/002* (2013.01); *D21F 11/02* (2013.01); *D21H 13/24* (2013.01); *D21H 15/04* (2013.01); *D21H 17/35* (2013.01); *D21H 21/16* (2013.01); *D04H 1/5414* (2020.05); *D04H 1/5416* (2020.05); *D10B 2321/021* (2013.01); *D10B 2331/04* (2013.01)

(58) Field of Classification Search
CPC ..... D21H 17/36; D21H 27/38; D21H 13/24; D21H 15/04; D21H 17/35; D21H 21/16; D21H 21/56; D21F 11/002; D21F 11/02; B32B 2262/0276; B32B 2262/067; B32B 2262/14; B32B 29/007; D10B 2321/021; D10B 2331/04; D04H 1/593; D04H 1/425; D04H 1/4374; D04H 1/559; D04H 1/732; D04H 1/541; D04H 1/5412
See application file for complete search history.

(56) References Cited

U.S. PATENT DOCUMENTS

| | | | |
|---|---|---|---|
| 2,105,711 | A | 1/1938 | Weathered |
| 2,791,523 | A | 5/1957 | Schoen |
| 3,007,840 | A | 11/1961 | Wilcox |
| 3,506,538 | A | 4/1970 | Friedberg et al. |

(Continued)

FOREIGN PATENT DOCUMENTS

| | | | |
|---|---|---|---|
| AT | 517303 | A1 | 12/2016 |
| AT | 519414 | A2 | 6/2018 |

(Continued)

OTHER PUBLICATIONS

Hubbe et al., in "Wet-Laid Nonwovens Manufacture Chemical Approaches Using Synthetic and Cellulosic Fibers" BioResources 11(2) pp. 5500-5552. (Year: 2016).*

(Continued)

*Primary Examiner* — Jose A Fortuna

(74) *Attorney, Agent, or Firm* — Kimberly-Clark Worldwide, Inc.

(57) ABSTRACT

A method for producing a foam-formed multilayered substrate that includes producing an aqueous-based foam including at least 3% by weight non-straight synthetic binder fibers, wherein the non-straight synthetic binder fibers have an average length greater than 2 mm; forming together a wet sheet layer from the aqueous-based foam and a cellulosic fiber layer, wherein the cellulosic fiber layer includes at least 60 percent by weight cellulosic fibers; and drying the combined layers to obtain the foam-formed multilayer substrate. A multilayered substrate includes a first layer including at least 60 percent by weight non-straight synthetic binder fibers having an average length greater than 2 mm; and a second layer including at least 60 percent by weight cellulosic fiber, wherein the first layer is in a facing relationship with the second layer, and wherein the multilayered substrate has a wet/dry tensile ratio of at least 60%.

14 Claims, 2 Drawing Sheets

(56) References Cited

U.S. PATENT DOCUMENTS 3,542,640 A 11/1970 Friedberg et al.
3,615,975 A 10/1971 Gillern et al.
3,716,449 A 2/1973 Gatward et al.
3,798,122 A 3/1974 Appel
3,837,999 A 9/1974 Chung
3,839,142 A 10/1974 Clarke et al.
3,871,952 A 3/1975 Robertson
3,929,560 A 12/1975 Holik et al.
3,938,782 A 2/1976 Robertson
3,966,540 A 6/1976 Selander et al.
4,007,083 A 2/1977 Ring et al.
4,049,491 A 9/1977 Brandon et al.
4,062,721 A 12/1977 Guyer et al.
4,123,787 A 10/1978 Leclerc du Sablon et al.
4,200,488 A 4/1980 Brandon et al.
4,285,767 A 8/1981 Page
4,288,475 A 9/1981 Meeker
4,299,655 A 11/1981 Skaugen
4,394,930 A 7/1983 Korpman
4,415,388 A 11/1983 Korpman
4,443,232 A 4/1984 Kaiser
4,443,297 A 4/1984 Cheshire et al.
4,443,299 A 4/1984 Cheshire et al.
4,464,224 A 8/1984 Matolcsy
4,478,615 A 10/1984 Kaiser
4,483,976 A * 11/1984 Yamamoto ..... D01F 6/86
528/275
4,498,956 A 2/1985 Cheshire et al.
4,543,156 A 9/1985 Cheshire et al.
4,613,627 A 9/1986 Sherman et al.
4,655,950 A 4/1987 Michalek
4,686,006 A 8/1987 Cheshire et al.
4,734,321 A 3/1988 Radvan et al.
4,764,253 A 8/1988 Cheshire et al.
4,773,408 A 9/1988 Cilento et al.
4,773,409 A 9/1988 Cilento et al.
4,778,477 A 10/1988 Lauchenauer
4,883,478 A 11/1989 Lerailler et al.
4,939,030 A 7/1990 Tsuji et al.
4,944,843 A 7/1990 Wallace et al.
4,948,007 A 8/1990 Berg et al.
4,952,448 A 8/1990 Bullock et al.
4,969,975 A 11/1990 Biggs et al.
4,973,382 A 11/1990 Kinn et al.
4,985,467 A 1/1991 Kelly et al.
5,006,373 A 4/1991 Woodmansee et al.
5,008,306 A 4/1991 Goguelin
5,013,405 A 5/1991 Izard
5,064,653 A 11/1991 Sessions et al.
5,065,752 A 11/1991 Sessions et al.
5,073,416 A 12/1991 Avakian et al.
5,098,778 A 3/1992 Minnick
5,102,501 A 4/1992 Eber et al.
5,134,959 A 8/1992 Woodmansee et al.
5,137,551 A 8/1992 Ahrens et al.
5,147,345 A 9/1992 Young et al.
5,153,058 A 10/1992 Hall et al.
5,164,045 A 11/1992 Awofeso et al.
5,178,729 A 1/1993 Janda
5,196,090 A 3/1993 Corbellini et al.
5,200,035 A 4/1993 Bhat et al.
5,227,023 A 7/1993 Pounder et al.
5,238,534 A 8/1993 Manning et al.
5,260,017 A 11/1993 Giles
5,260,345 A 11/1993 DesMarais et al.
5,268,224 A 12/1993 DesMarais et al.
5,300,565 A 4/1994 Berg et al.
5,308,565 A 5/1994 Weber et al.
5,318,554 A 6/1994 Young et al.
5,328,935 A 7/1994 Van Phan et al.
5,330,822 A 7/1994 Berg et al.
5,331,015 A 7/1994 DesMarais et al.
5,338,766 A 8/1994 Phan et al.
5,344,866 A 9/1994 Hall
5,348,453 A 9/1994 Baran et al.
5,369,007 A 11/1994 Kidwell
5,372,766 A 12/1994 Roe
5,384,179 A 1/1995 Roe et al.
5,387,207 A 2/1995 Dyer et al.
5,393,379 A 2/1995 Parrinello
5,397,316 A 3/1995 LaVon et al.
5,397,626 A 3/1995 Berg et al.
5,409,572 A 4/1995 Kershaw et al.
5,428,076 A 6/1995 Roe
5,434,194 A 7/1995 Fujimoto et al.
5,451,452 A 9/1995 Phan et al.
5,468,437 A 11/1995 Hall
5,506,046 A 4/1996 Andersen et al.
5,506,277 A 4/1996 Griesbach
5,508,072 A 4/1996 Andersen et al.
5,533,244 A 7/1996 Wadzinski
5,536,264 A 7/1996 Hsueh et al.
5,545,450 A 8/1996 Andersen et al.
5,549,589 A 8/1996 Homey et al.
5,550,167 A 8/1996 DesMarais
5,560,878 A 10/1996 Dragoo et al.
5,563,179 A 10/1996 Stone et al.
D375,633 S 11/1996 Spanagel et al.
5,571,849 A 11/1996 DesMarais
5,580,624 A 12/1996 Andersen et al.
5,582,670 A 12/1996 Andersen et al.
5,585,432 A 12/1996 Lee et al.
5,586,842 A 12/1996 Bae et al.
5,599,334 A 2/1997 Johnston et al.
5,612,385 A 3/1997 Ceaser et al.
D378,876 S 4/1997 Spanagel et al.
5,618,341 A 4/1997 Andersen et al.
5,624,971 A 4/1997 Wilson
5,626,857 A 5/1997 Thimineur et al.
5,631,053 A 5/1997 Andersen et al.
5,632,737 A 5/1997 Stone et al.
5,633,291 A 5/1997 Dyer et al.
5,649,409 A 7/1997 Gujer et al.
5,650,222 A 7/1997 DesMarais et al.
D381,810 S 8/1997 Schultz et al.
5,658,603 A 8/1997 Andersen et al.
5,660,900 A 8/1997 Andersen et al.
5,660,903 A 8/1997 Andersen et al.
5,660,904 A 8/1997 Andersen et al.
5,662,731 A 9/1997 Andersen et al.
5,665,442 A 9/1997 Andersen et al.
5,674,917 A 10/1997 Wilson
5,679,145 A 10/1997 Andersen et al.
5,679,218 A 10/1997 Vinson et al.
5,683,772 A 11/1997 Andersen et al.
5,691,014 A 11/1997 Andersen et al.
5,692,939 A 12/1997 DesMarais
5,693,403 A 12/1997 Brown et al.
5,695,607 A 12/1997 Oriaran et al.
5,702,571 A 12/1997 Kamps et al.
5,705,203 A 1/1998 Andersen et al.
5,705,238 A 1/1998 Andersen et al.
5,705,239 A 1/1998 Andersen et al.
5,705,242 A 1/1998 Andersen et al.
5,707,474 A 1/1998 Andersen et al.
5,707,579 A 1/1998 Habelski et al.
5,709,827 A 1/1998 Andersen et al.
5,709,913 A 1/1998 Andersen et al.
D390,363 S 2/1998 Baum et al.
5,713,881 A 2/1998 Rezai et al.
5,716,563 A 2/1998 Winterowd et al.
5,716,675 A 2/1998 Andersen et al.
5,719,201 A 2/1998 Wilson
5,720,851 A 2/1998 Reiner
5,728,743 A 3/1998 Dyer et al.
5,736,209 A 4/1998 Andersen et al.
5,741,581 A 4/1998 DesMarais et al.
5,744,506 A 4/1998 Goldman et al.
5,744,509 A 4/1998 Wilson et al.
5,753,308 A 5/1998 Andersen et al.
5,753,359 A 5/1998 Dyer et al.
5,763,499 A 6/1998 DesMarais
5,770,634 A 6/1998 Dyer et al.
5,776,388 A 7/1998 Andersen et al.

(56) References Cited

U.S. PATENT DOCUMENTS

| | | | |
|---|---|---|---|
| 5,783,126 | A | 7/1998 | Andersen et al. |
| 5,795,921 | A | 8/1998 | Dyer et al. |
| 5,800,416 | A | 9/1998 | Seger et al. |
| 5,800,647 | A | 9/1998 | Andersen et al. |
| 5,810,961 | A | 9/1998 | Andersen et al. |
| 5,817,703 | A | 10/1998 | Blair et al. |
| 5,830,305 | A | 11/1998 | Andersen et al. |
| 5,843,055 | A | 12/1998 | Seger |
| 5,843,544 | A | 12/1998 | Andersen et al. |
| 5,849,155 | A | 12/1998 | Gasland |
| 5,849,805 | A | 12/1998 | Dyer |
| 5,851,634 | A | 12/1998 | Andersen et al. |
| 5,851,648 | A | 12/1998 | Stone et al. |
| 5,853,402 | A | 12/1998 | Faulks et al. |
| 5,863,958 | A | 1/1999 | Dyer et al. |
| 5,868,724 | A | 2/1999 | Dierckes et al. |
| 5,876,643 | A | 3/1999 | Biggs et al. |
| 5,879,722 | A | 3/1999 | Andersen et al. |
| 5,882,479 | A | 3/1999 | Oriaran et al. |
| 5,899,893 | A | 5/1999 | Dyer et al. |
| 5,900,114 | A | 5/1999 | Brown et al. |
| 5,904,809 | A | 5/1999 | Rokman et al. |
| 5,904,812 | A | 5/1999 | Salman et al. |
| 5,908,533 | A | 6/1999 | Marinack et al. |
| 5,916,503 | A | 6/1999 | Rettenbacher |
| 5,916,928 | A | 6/1999 | Sessions et al. |
| 5,919,411 | A | 7/1999 | Rezai et al. |
| 5,922,780 | A | 7/1999 | Dyer et al. |
| 5,925,299 | A | 7/1999 | Dierckes et al. |
| 5,928,741 | A | 7/1999 | Andersen et al. |
| 5,948,829 | A | 9/1999 | Wallajapet et al. |
| 5,958,186 | A | 9/1999 | Holm et al. |
| 5,976,235 | A | 11/1999 | Andersen et al. |
| 5,985,434 | A | 11/1999 | Qin et al. |
| 6,001,218 | A | 12/1999 | Hsu et al. |
| 6,013,293 | A | 1/2000 | De Moor |
| 6,013,589 | A | 1/2000 | DesMarais et al. |
| 6,017,833 | A | 1/2000 | Reiner et al. |
| 6,019,871 | A | 2/2000 | Rokman et al. |
| 6,022,615 | A | 2/2000 | Rettenbacher |
| 6,027,610 | A | 2/2000 | Back et al. |
| 6,028,018 | A | 2/2000 | Amundson et al. |
| 6,030,673 | A | 2/2000 | Andersen et al. |
| 6,037,282 | A | 3/2000 | Milding et al. |
| D423,232 | S | 4/2000 | Reid |
| 6,051,104 | A | 4/2000 | Oriaran et al. |
| 6,054,022 | A | 4/2000 | Helwig et al. |
| 6,074,527 | A | 6/2000 | Hsu et al. |
| 6,077,390 | A | 6/2000 | Salman et al. |
| 6,077,590 | A | 6/2000 | Archer et al. |
| 6,083,211 | A | 7/2000 | DesMarais |
| 6,083,586 | A | 7/2000 | Andersen et al. |
| 6,086,718 | A | 7/2000 | Carter et al. |
| 6,090,195 | A | 7/2000 | Andersen et al. |
| 6,093,359 | A | 7/2000 | Gauchel et al. |
| 6,096,809 | A | 8/2000 | Lorcks et al. |
| 6,103,060 | A | 8/2000 | Munerelle et al. |
| 6,103,063 | A | 8/2000 | Oriaran et al. |
| D430,406 | S | 9/2000 | Ingalls |
| D430,407 | S | 9/2000 | Ingalls |
| D430,734 | S | 9/2000 | Bredendick et al. |
| 6,113,740 | A | 9/2000 | Oriaran et al. |
| D431,371 | S | 10/2000 | Ingalls et al. |
| D431,372 | S | 10/2000 | Ingalls et al. |
| 6,133,193 | A | 10/2000 | Kajikawa et al. |
| 6,136,153 | A | 10/2000 | Rokman et al. |
| 6,136,873 | A | 10/2000 | Hahnle et al. |
| 6,153,053 | A | 11/2000 | Harper et al. |
| 6,160,028 | A | 12/2000 | Dyer |
| 6,162,961 | A | 12/2000 | Tanner et al. |
| 6,163,943 | A | 12/2000 | Johansson et al. |
| D436,738 | S | 1/2001 | Bredendick et al. |
| 6,168,857 | B1 | 1/2001 | Andersen et al. |
| 6,174,152 | B1 | 1/2001 | Rokman et al. |
| 6,174,929 | B1 | 1/2001 | Hnle et al. |
| D437,119 | S | 2/2001 | Jahner et al. |
| D437,120 | S | 2/2001 | Jahner et al. |
| D437,489 | S | 2/2001 | Jahner et al. |
| D438,017 | S | 2/2001 | Reid |
| 6,193,838 | B1 | 2/2001 | Oriaran et al. |
| 6,200,404 | B1 | 3/2001 | Andersen et al. |
| 6,203,663 | B1 | 3/2001 | Kamps et al. |
| 6,207,244 | B1 | 3/2001 | Hesch |
| D440,051 | S | 4/2001 | Bredendick et al. |
| 6,214,907 | B1 | 4/2001 | Tomka |
| 6,231,960 | B1 | 5/2001 | Dyer et al. |
| 6,231,970 | B1 | 5/2001 | Andersen et al. |
| 6,235,816 | B1 | 5/2001 | Lorcks et al. |
| 6,238,518 | B1 | 5/2001 | Rokman et al. |
| D443,766 | S | 6/2001 | Bredendick et al. |
| 6,243,934 | B1 | 6/2001 | Wadzinski |
| 6,245,410 | B1 | 6/2001 | Hähnle et al. |
| 6,245,697 | B1 | 6/2001 | Conrad et al. |
| 6,248,211 | B1 | 6/2001 | Jennings et al. |
| 6,251,207 | B1 | 6/2001 | Schultz et al. |
| 6,258,203 | B1 | 7/2001 | Rokman et al. |
| 6,261,679 | B1 | 7/2001 | Chen et al. |
| 6,274,077 | B1 | 8/2001 | Hur et al. |
| 6,280,570 | B1 | 8/2001 | Harper et al. |
| 6,287,417 | B1 | 9/2001 | Bhat |
| 6,287,422 | B1 | 9/2001 | Harper et al. |
| 6,296,736 | B1 | 10/2001 | Hsu et al. |
| 6,296,929 | B1 | 10/2001 | Gentile et al. |
| 6,309,661 | B1 | 10/2001 | Haynes et al. |
| 6,328,850 | B1 | 12/2001 | Phan et al. |
| 6,355,142 | B1 | 3/2002 | Ahrens |
| 6,372,087 | B2 | 4/2002 | Harper et al. |
| 6,376,032 | B1 | 4/2002 | Clarke et al. |
| 6,387,210 | B1 | 5/2002 | Hsu et al. |
| D459,897 | S | 7/2002 | Bredendick et al. |
| 6,413,368 | B1 | 7/2002 | Dwiggins et al. |
| 6,419,790 | B1 | 7/2002 | Leege et al. |
| 6,425,983 | B1 | 7/2002 | Marinack et al. |
| 6,432,272 | B1 | 8/2002 | Hollenberg et al. |
| 6,436,234 | B1 | 8/2002 | Chen et al. |
| 6,440,266 | B1 | 8/2002 | George et al. |
| 6,443,258 | B1 | 9/2002 | Putt et al. |
| 6,444,088 | B2 | 9/2002 | Rökman et al. |
| 6,447,640 | B1 | 9/2002 | Watson et al. |
| 6,451,166 | B1 | 9/2002 | Marinack et al. |
| 6,455,600 | B1 | 9/2002 | Hähnle et al. |
| 6,472,497 | B2 | 10/2002 | Loercks et al. |
| 6,500,302 | B2 | 12/2002 | Dwiggins et al. |
| 6,503,372 | B1 | 1/2003 | Rokman et al. |
| 6,518,479 | B1 | 2/2003 | Graef et al. |
| 6,525,240 | B1 | 2/2003 | Graef et al. |
| 6,527,913 | B1 | 3/2003 | Johnson et al. |
| 6,531,078 | B2 | 3/2003 | Laine et al. |
| 6,540,879 | B2 | 4/2003 | Marinack et al. |
| 6,544,386 | B1 | 4/2003 | Krzysik et al. |
| 6,548,132 | B1 | 4/2003 | Clarke et al. |
| 6,562,193 | B1 | 5/2003 | Elonen et al. |
| 6,589,634 | B2 | 7/2003 | Schultz et al. |
| 6,596,389 | B1 | 7/2003 | Hallett et al. |
| 6,600,086 | B1 | 7/2003 | Mace et al. |
| 6,603,054 | B2 | 8/2003 | Chen et al. |
| 6,613,424 | B1 | 9/2003 | Putt et al. |
| 6,616,802 | B1 | 9/2003 | Kinsley, Jr. et al. |
| 6,630,054 | B1 | 10/2003 | Graef et al. |
| 6,649,025 | B2 | 11/2003 | Mills et al. |
| 6,657,101 | B1 | 12/2003 | Malmgren et al. |
| 6,663,611 | B2 | 12/2003 | Blaney et al. |
| 6,670,522 | B1 | 12/2003 | Graef et al. |
| 6,673,980 | B1 | 1/2004 | Varona et al. |
| 6,673,983 | B1 | 1/2004 | Graef et al. |
| 6,682,215 | B2 | 1/2004 | Kinsley, Jr. et al. |
| 6,689,934 | B2 | 2/2004 | Dodge, II et al. |
| 6,703,330 | B1 | 3/2004 | Marsh |
| 6,706,944 | B2 | 3/2004 | Qin et al. |
| 6,709,548 | B2 | 3/2004 | Marinack et al. |
| 6,709,550 | B2 | 3/2004 | Holz et al. |
| 6,733,631 | B2 | 5/2004 | Elonen et al. |
| 6,734,335 | B1 | 5/2004 | Graef et al. |
| 6,746,570 | B2 | 6/2004 | Burazin et al. |

(56) References Cited

U.S. PATENT DOCUMENTS 6,749,719 B2 6/2004 Burazin et al.
6,750,262 B1 6/2004 Hähnle et al.
6,752,907 B2 6/2004 Edwards et al.
6,780,356 B1 8/2004 Putt et al.
6,787,000 B2 9/2004 Burazin et al.
6,790,314 B2 9/2004 Burazin et al.
6,797,114 B2 9/2004 Hu
6,808,790 B2 10/2004 Chen et al.
6,821,385 B2 11/2004 Burazin et al.
6,821,387 B2 11/2004 Hu
6,821,388 B2 11/2004 Marsh
6,824,650 B2 11/2004 Lindsay et al.
6,830,656 B2 12/2004 Kinsley, Jr.
6,837,956 B2 1/2005 Cowell et al.
6,837,972 B2 1/2005 Marsh
6,861,380 B2 3/2005 Garnier et al.
6,861,477 B2 3/2005 Wang et al.
6,867,346 B1 3/2005 Dopps et al.
6,875,315 B2 4/2005 Bakken et al.
6,878,238 B2 4/2005 Bakken et al.
6,887,348 B2 5/2005 Hermans et al.
6,887,350 B2 5/2005 Garnier et al.
6,893,535 B2 5/2005 Hermans et al.
6,921,459 B2 7/2005 Kinsley, Jr. et al.
6,924,030 B2 * 8/2005 Kamada ..... D01D 5/253 264/185
6,939,914 B2 9/2005 Qin et al.
6,946,058 B2 9/2005 Hu
6,951,598 B2 10/2005 Flugge et al.
6,956,009 B2 10/2005 Wang et al.
6,962,645 B2 11/2005 Graef et al.
6,964,725 B2 11/2005 Shannon et al.
6,969,781 B2 11/2005 Graef et al.
6,983,821 B2 1/2006 Putt et al.
D517,816 S 3/2006 Dwiggins et al.
7,029,756 B2 4/2006 Moline et al.
D519,739 S 5/2006 Schuh et al.
7,041,196 B2 5/2006 Lorenz et al.
7,045,026 B2 5/2006 Lorenz et al.
7,052,580 B2 5/2006 Trokhan et al.
7,066,006 B2 6/2006 Minerath, III et al.
7,067,038 B2 6/2006 Trokhan et al.
7,081,559 B2 7/2006 Fujikawa et al.
7,125,470 B2 10/2006 Graef et al.
7,141,142 B2 11/2006 Burazin et al.
7,155,991 B2 1/2007 Minerath, III et al.
7,156,954 B2 1/2007 Farrington, Jr et al.
7,160,418 B2 1/2007 Edwards et al.
7,166,190 B2 1/2007 Graef et al.
7,169,451 B2 1/2007 Clarke et al.
7,214,293 B2 5/2007 Trokhan et al.
7,220,821 B2 5/2007 Hähnle et al.
7,229,528 B2 6/2007 Vinson et al.
7,235,708 B2 6/2007 Guidotti et al.
D551,406 S 9/2007 Caruso et al.
7,285,183 B2 10/2007 Kajander et al.
7,287,650 B2 10/2007 Koslow
7,291,382 B2 11/2007 Krueger et al.
7,294,238 B2 11/2007 Bakken et al.
7,300,547 B2 11/2007 Luu et al.
7,311,800 B2 12/2007 Russell et al.
7,314,663 B2 1/2008 Stelljes, Jr. et al.
7,314,664 B2 1/2008 Stelljes, Jr. et al.
7,314,665 B2 1/2008 Stelljes, Jr. et al.
7,322,970 B2 1/2008 Schmidt et al.
7,354,502 B2 4/2008 Polat et al.
7,364,015 B2 4/2008 Englert et al.
7,374,638 B2 5/2008 Horenziak et al.
7,390,378 B2 6/2008 Carels et al.
7,396,436 B2 7/2008 Trokhan et al.
7,407,560 B2 8/2008 Hilbig et al.
7,413,629 B2 8/2008 Fisher et al.
7,416,636 B2 * 8/2008 Blomqvist ..... D21F 11/002 162/101
7,416,637 B2 8/2008 Murray et al.
7,435,266 B2 10/2008 Sun et al.
7,435,313 B2 10/2008 Boatman et al.
7,435,316 B2 10/2008 Boatman et al.
7,494,563 B2 2/2009 Edwards et al.
7,497,923 B2 3/2009 Ward et al.
7,497,925 B2 3/2009 Hermans et al.
7,497,926 B2 3/2009 Hermans et al.
7,503,998 B2 3/2009 Murray et al.
7,524,399 B2 4/2009 Hermans et al.
7,524,404 B2 4/2009 Boatman et al.
7,585,388 B2 9/2009 Yeh et al.
7,585,389 B2 9/2009 Yeh et al.
7,597,777 B2 10/2009 Wilke, II
7,601,374 B2 10/2009 Clarke
7,629,043 B2 12/2009 Lindsay et al.
7,645,359 B2 1/2010 Lorenz et al.
7,662,257 B2 2/2010 Edwards et al.
7,670,457 B2 3/2010 Murray et al.
7,678,229 B2 3/2010 Wilke, II
7,678,231 B2 3/2010 Dyer et al.
7,682,697 B2 3/2010 Raghavendran et al.
7,691,228 B2 4/2010 Edwards et al.
7,699,959 B2 4/2010 Ward et al.
7,744,576 B2 6/2010 Busam et al.
7,750,203 B2 7/2010 Becker et al.
7,775,958 B2 8/2010 Mukai et al.
7,785,696 B2 8/2010 Boatman et al.
7,794,565 B2 9/2010 Shannon et al.
7,799,161 B2 9/2010 Schuh et al.
7,799,968 B2 9/2010 Chen et al.
7,820,008 B2 10/2010 Edwards et al.
7,828,932 B2 11/2010 Hermans et al.
7,846,296 B2 12/2010 Luu et al.
7,850,823 B2 12/2010 Chou et al.
7,851,057 B2 12/2010 Englert et al.
7,851,667 B2 12/2010 Becker et al.
7,857,941 B2 12/2010 Ruthven et al.
7,862,686 B2 1/2011 Ward et al.
7,887,676 B2 2/2011 Boatman et al.
7,918,951 B2 4/2011 Lorenz et al.
7,918,964 B2 4/2011 Edwards et al.
7,918,972 B2 4/2011 Boatman et al.
7,927,456 B2 4/2011 Murray et al.
7,972,476 B2 7/2011 Scherb et al.
7,994,079 B2 8/2011 Chen et al.
8,007,640 B2 8/2011 Boatman et al.
8,017,827 B2 9/2011 Hundorf et al.
8,056,733 B2 11/2011 Koslow
8,083,893 B2 12/2011 Boatman et al.
8,092,848 B2 1/2012 Clarke
8,102,275 B2 1/2012 McGuire et al.
8,110,232 B2 2/2012 Clarke
8,123,905 B2 2/2012 Luu et al.
8,142,612 B2 3/2012 Murray et al.
8,142,617 B2 3/2012 Ruthven et al.
8,143,472 B1 3/2012 Bragd et al.
8,152,957 B2 4/2012 Edwards et al.
8,152,958 B2 4/2012 Super et al.
8,158,689 B2 4/2012 Baker et al.
8,178,025 B2 5/2012 Awofeso et al.
8,187,240 B2 5/2012 Busam et al.
8,187,427 B2 5/2012 Schuh et al.
8,211,078 B2 7/2012 Noel
8,226,797 B2 7/2012 Murray et al.
8,257,552 B2 9/2012 Edwards et al.
8,293,072 B2 10/2012 Super et al.
8,319,005 B2 11/2012 Becker et al.
8,324,446 B2 12/2012 Wang et al.
8,328,985 B2 12/2012 Edwards et al.
8,361,278 B2 1/2013 Fike et al.
8,378,000 B2 2/2013 Hintz et al.
8,388,803 B2 3/2013 Super et al.
8,388,804 B2 3/2013 Super et al.
8,394,236 B2 3/2013 Edwards et al.
8,398,818 B2 3/2013 Edwards et al.
8,398,820 B2 3/2013 Edwards et al.
8,425,721 B2 4/2013 Tynkkynen et al.
8,435,381 B2 5/2013 Murray et al.
8,461,412 B2 6/2013 Febo et al.

(56) References Cited

U.S. PATENT DOCUMENTS

| | | | |
|---|---|---|---|
| 8,496,637 | B2 | 7/2013 | Hundorf et al. |
| 8,512,516 | B2 | 8/2013 | Murray et al. |
| 8,524,040 | B2 | 9/2013 | Edwards et al. |
| 8,540,846 | B2 | 9/2013 | Miller et al. |
| 8,545,676 | B2 | 10/2013 | Super et al. |
| 8,552,252 | B2 | 10/2013 | Hundorf et al. |
| 8,562,786 | B2 | 10/2013 | Murray et al. |
| 8,568,559 | B2 | 10/2013 | Murray et al. |
| 8,568,560 | B2 | 10/2013 | Murray et al. |
| 8,603,296 | B2 | 12/2013 | Edwards et al. |
| 8,632,658 | B2 | 1/2014 | Miller et al. |
| 8,636,874 | B2 | 1/2014 | Super et al. |
| 8,647,105 | B2 | 2/2014 | Awofeso et al. |
| 8,652,300 | B2 | 2/2014 | Super et al. |
| 8,662,344 | B2 | 3/2014 | Gispert |
| 8,673,115 | B2 | 3/2014 | Edwards et al. |
| 8,674,170 | B2 | 3/2014 | Busam et al. |
| 8,702,668 | B2 | 4/2014 | Noel |
| 8,741,105 | B2 | 6/2014 | Beaupre et al. |
| 8,766,031 | B2 | 7/2014 | Becker et al. |
| 8,778,138 | B2 | 7/2014 | Super et al. |
| 8,791,318 | B2 | 7/2014 | Becker et al. |
| 8,815,056 | B2 | 8/2014 | Araki et al. |
| 8,829,263 | B2 | 9/2014 | Haggstrom et al. |
| 8,841,506 | B2 | 9/2014 | Febo et al. |
| 8,852,397 | B2 | 10/2014 | Super et al. |
| 8,864,944 | B2 | 10/2014 | Miller et al. |
| 8,864,945 | B2 | 10/2014 | Miller et al. |
| 8,911,592 | B2 | 12/2014 | Edwards et al. |
| 8,968,516 | B2 | 3/2015 | Super et al. |
| 8,979,815 | B2 | 3/2015 | Roe et al. |
| 8,980,052 | B2 | 3/2015 | Super et al. |
| 9,017,517 | B2 | 4/2015 | Super et al. |
| 9,044,359 | B2 | 6/2015 | Wciorka et al. |
| 9,051,691 | B2 | 6/2015 | Miller et al. |
| 9,057,158 | B2 | 6/2015 | Miller et al. |
| 9,138,360 | B1 | 9/2015 | Febo et al. |
| 9,144,524 | B2 | 9/2015 | Febo et al. |
| 9,216,116 | B2 | 12/2015 | Roe et al. |
| 9,216,118 | B2 | 12/2015 | Roe et al. |
| 9,228,048 | B2 | 1/2016 | Wibaux et al. |
| 9,241,845 | B2 | 1/2016 | Hundorf et al. |
| 9,243,367 | B2 | 1/2016 | Rekoske et al. |
| 9,267,240 | B2 | 2/2016 | Lee et al. |
| 9,279,219 | B2 | 3/2016 | Edwards et al. |
| 9,309,627 | B2 | 4/2016 | Miller et al. |
| 9,326,896 | B2 | 5/2016 | Schafer et al. |
| 9,333,120 | B2 | 5/2016 | Lavon et al. |
| 9,334,610 | B2 | 5/2016 | Kinnunen et al. |
| 9,340,363 | B2 | 5/2016 | Jackels et al. |
| 9,365,977 | B2 | 6/2016 | Beaupre et al. |
| 9,371,614 | B2 | 6/2016 | Schuh et al. |
| 9,371,615 | B2 | 6/2016 | Super et al. |
| 9,375,358 | B2 | 6/2016 | Ehmsperger et al. |
| 9,382,665 | B2 | 7/2016 | Miller et al. |
| 9,388,534 | B2 | 7/2016 | Super et al. |
| 9,447,543 | B2 | 9/2016 | Matula |
| 9,468,566 | B2 | 10/2016 | Rosati et al. |
| 9,476,162 | B2 | 10/2016 | Lee et al. |
| 9,492,328 | B2 | 11/2016 | Jackels et al. |
| 9,493,911 | B2 | 11/2016 | Miller et al. |
| 9,532,910 | B2 | 1/2017 | Rosati et al. |
| 9,572,728 | B2 | 2/2017 | Ashton et al. |
| 9,579,238 | B2 | 2/2017 | Noel |
| 9,603,755 | B2 | 3/2017 | Tanaka |
| 9,649,232 | B2 | 5/2017 | Hippe et al. |
| 9,649,830 | B2 | 5/2017 | Rasch |
| 9,657,443 | B2 | 5/2017 | Rekoske et al. |
| 9,662,246 | B2 | 5/2017 | Collinson et al. |
| 9,668,926 | B2 | 6/2017 | Jackels et al. |
| 9,708,774 | B2 | 7/2017 | Lee et al. |
| 9,713,556 | B2 | 7/2017 | Arizti et al. |
| 9,713,557 | B2 | 7/2017 | Arizti et al. |
| 9,739,015 | B2 | 8/2017 | Miller et al. |
| 9,744,755 | B2 | 8/2017 | Thompson, Jr. et al. |
| 9,752,280 | B2 | 9/2017 | Matula |
| 9,763,835 | B2 | 9/2017 | Becker et al. |
| 9,789,009 | B2 | 10/2017 | Joseph |
| 9,789,011 | B2 | 10/2017 | Roe et al. |
| 9,808,554 | B2 | 11/2017 | Swaniker |
| 9,822,487 | B2 | 11/2017 | Ahoniemi et al. |
| 9,877,872 | B2 | 1/2018 | Mumby et al. |
| 9,879,382 | B2 | 1/2018 | Miller et al. |
| 9,950,309 | B2 | 4/2018 | Lee et al. |
| 9,963,568 | B2 | 5/2018 | Nakatsuji et al. |
| 9,974,697 | B2 | 5/2018 | Lavon et al. |
| 9,974,699 | B2 | 5/2018 | Kreuzer et al. |
| 9,987,176 | B2 | 6/2018 | Roe et al. |
| 9,988,763 | B2 | 6/2018 | Ramaratnam et al. |
| 9,994,712 | B2 | 6/2018 | Cai et al. |
| 9,995,005 | B2 | 6/2018 | Ramaratnam et al. |
| 10,004,647 | B2 | 6/2018 | Jackels et al. |
| 10,022,280 | B2 | 7/2018 | Ehrnsperger et al. |
| 10,034,800 | B2 | 7/2018 | Febo et al. |
| 10,039,673 | B2 | 8/2018 | Mumby et al. |
| 10,039,676 | B2 | 8/2018 | LaVon |
| 10,052,242 | B2 | 8/2018 | Bianchi et al. |
| 10,065,175 | B2 | 9/2018 | Lee et al. |
| 10,071,002 | B2 | 9/2018 | Bianchi et al. |
| 10,076,449 | B2 | 9/2018 | Allen et al. |
| 10,099,425 | B2 | 10/2018 | Miller, IV et al. |
| 10,130,519 | B2 | 11/2018 | Mumby et al. |
| 10,130,525 | B2 | 11/2018 | Rosati et al. |
| 10,130,527 | B2 | 11/2018 | Peri et al. |
| 10,137,039 | B2 | 11/2018 | Stelzig et al. |
| 10,138,600 | B2 | 11/2018 | Jannari et al. |
| 10,149,788 | B2 | 12/2018 | Kreuzer et al. |
| 10,190,263 | B2 | 1/2019 | Ramaratnam et al. |
| 10,196,780 | B2 | 2/2019 | Lee et al. |
| 10,201,644 | B2 | 2/2019 | Haggstrom et al. |
| 10,208,426 | B2 | 2/2019 | Sealey et al. |
| 10,221,350 | B2 | 3/2019 | Shalagina et al. |
| 10,231,874 | B2 | 3/2019 | Mumby et al. |
| 10,245,188 | B2 | 4/2019 | Jackels et al. |
| 10,247,195 | B2 | 4/2019 | Manninen et al. |
| 10,253,434 | B2 * | 4/2019 | Nakamura ..... D21H 15/02 |
| 10,259,151 | B2 | 4/2019 | Kiiskinen et al. |
| 10,273,635 | B2 | 4/2019 | Miller, IV et al. |
| 10,292,875 | B2 | 5/2019 | Tapp et al. |
| 10,301,775 | B2 | 5/2019 | Nordström et al. |
| 10,301,779 | B2 | 5/2019 | Sealey, II et al. |
| 10,322,040 | B2 | 6/2019 | Stiehl et al. |
| 10,335,324 | B2 | 7/2019 | Roe et al. |
| 10,619,303 | B2 | 4/2020 | Thole et al. |
| 11,015,292 | B2 | 5/2021 | Venema et al. |
| 11,136,700 | B2 | 10/2021 | Venema et al. |
| 2001/0013389 | A1 | 8/2001 | Fingal et al. |
| 2002/0007169 | A1 | 1/2002 | Graef et al. |
| 2002/0013560 | A1 | 1/2002 | Erspamer et al. |
| 2002/0055310 | A1 | 5/2002 | Falk et al. |
| 2002/0088581 | A1 | 7/2002 | Graef et al. |
| 2002/0092634 | A1 | 7/2002 | Rokman et al. |
| 2002/0132121 | A1 | 9/2002 | Palacio et al. |
| 2003/0106656 | A1 | 6/2003 | Johnson et al. |
| 2003/0134094 | A1 | 7/2003 | Zafiroglu et al. |
| 2003/0139715 | A1 | 7/2003 | Dodge et al. |
| 2003/0167045 | A1 | 9/2003 | Graef et al. |
| 2003/0171727 | A1 | 9/2003 | Graef et al. |
| 2003/0220039 | A1 | 11/2003 | Chen et al. |
| 2004/0045685 | A1 | 3/2004 | Horner et al. |
| 2004/0063367 | A1 | 4/2004 | Dodge et al. |
| 2004/0065420 | A1 | 4/2004 | Graef et al. |
| 2004/0084162 | A1 | 5/2004 | Shannon et al. |
| 2004/0084164 | A1 | 5/2004 | Shannon et al. |
| 2004/0096642 | A1 | 5/2004 | Maruyama et al. |
| 2004/0110017 | A1 | 6/2004 | Lonsky et al. |
| 2004/0111817 | A1 | 6/2004 | Chen et al. |
| 2004/0112783 | A1 | 6/2004 | Mukai et al. |
| 2004/0115419 | A1 | 6/2004 | Qin et al. |
| 2004/0115451 | A1 | 6/2004 | Lonsky et al. |
| 2004/0118530 | A1 | 6/2004 | Kressner et al. |
| 2004/0121680 | A1 | 6/2004 | Yahiaoui et al. |
| 2004/0127873 | A1 | 7/2004 | Varona et al. |
| 2004/0142620 | A1 | 7/2004 | Kinsley |

(56) References Cited

U.S. PATENT DOCUMENTS

2004/0157524 A1 8/2004 Polat et al.
2004/0254551 A1 12/2004 Carnes et al.
2004/0256066 A1 12/2004 Lindsay et al.
2005/0034826 A1 2/2005 Hu
2005/0039870 A1* 2/2005 Blomqvist ..... D21F 11/002 162/101
2005/0060933 A1 3/2005 Henson
2005/0090789 A1 4/2005 Graef et al.
2005/0095980 A1 5/2005 Chang
2005/0106223 A1 5/2005 Kelly
2005/0124709 A1 6/2005 Krueger et al.
2005/0136772 A1 6/2005 Chen et al.
2005/0142348 A1 6/2005 Kajander et al.
2005/0152954 A1 7/2005 Farrell et al.
2005/0230069 A1 10/2005 Hilbig et al.
2005/0244627 A1 11/2005 Travelute et al.
2005/0247397 A1 11/2005 Kraus et al.
2005/0247416 A1 11/2005 Forry et al.
2005/0267226 A1 12/2005 Wehr et al.
2006/0005916 A1 1/2006 Stelljes et al.
2006/0011315 A1 1/2006 Kinsley et al.
2006/0030632 A1 2/2006 Krueger et al.
2006/0081348 A1 4/2006 Graef et al.
2006/0135026 A1 6/2006 Arendt et al.
2006/0141880 A1 6/2006 Bascom et al.
2006/0142719 A1 6/2006 Vogt et al.
2006/0191357 A1 8/2006 Minerath et al.
2006/0266485 A1 11/2006 Knox et al.
2006/0266487 A1 11/2006 Scherb et al.
2007/0148433 A1 6/2007 Mallory et al.
2007/0179210 A1 8/2007 Swaniker
2007/0218485 A1 9/2007 Davis et al.
2007/0269644 A1 11/2007 Harper et al.
2008/0052859 A1 3/2008 Orlandi
2008/0179775 A1 7/2008 Palm et al.
2008/0312617 A1 12/2008 Hundorf et al.
2008/0312618 A1 12/2008 Hundorf et al.
2008/0312619 A1 12/2008 Ashton et al.
2008/0312620 A1 12/2008 Ashton et al.
2008/0312621 A1 12/2008 Hundorf et al.
2008/0312622 A1 12/2008 Hundorf et al.
2008/0312625 A1 12/2008 Hundorf et al.
2008/0312628 A1 12/2008 Hundorf et al.
2009/0000753 A1 1/2009 Vestola et al.
2009/0001635 A1 1/2009 Newson et al.
2009/0008275 A1 1/2009 Ferrari et al.
2009/0117365 A1 5/2009 Mallory et al.
2009/0131898 A1 5/2009 Malmgren et al.
2009/0205794 A1 8/2009 Scherb et al.
2009/0270005 A1 10/2009 Takahashi et al.
2010/0006498 A1* 1/2010 Duello ..... B32B 5/26 210/508
2010/0075858 A1 3/2010 Davis et al.
2010/0132144 A1 6/2010 Rautray
2010/0136294 A1 6/2010 Manifold et al.
2010/0251611 A1 10/2010 Henson
2010/0273716 A1 10/2010 Harris
2010/0327484 A1 12/2010 Schuh et al.
2011/0045261 A1 2/2011 Sellars
2012/0121674 A1 5/2012 Pedoja
2012/0177888 A1 7/2012 Escafere et al.
2013/0268062 A1 10/2013 Puckett et al.
2014/0102650 A1 4/2014 Qin et al.
2014/0189970 A1 7/2014 Fingal et al.
2014/0231037 A1 8/2014 Beaupre et al.
2014/0324007 A1 10/2014 Hundorf et al.
2015/0080823 A1 3/2015 Thompson et al.
2015/0144829 A1 5/2015 Grünbauer
2015/0284911 A1 10/2015 Juvonen et al.
2015/0330029 A1* 11/2015 Ramaratnam ..... B32B 3/30 15/104.93
2016/0160448 A1 6/2016 Miller, IV et al.
2016/0219810 A1 8/2016 Erkkilä et al.
2016/0353820 A1 12/2016 Baychar
2017/0016149 A1* 1/2017 Nakamura ..... D21H 15/02
2017/0335521 A1 11/2017 Lee
2017/0335522 A1 11/2017 Heiskanen et al.
2017/0362775 A1 12/2017 Juvonen et al.
2018/0119353 A1 5/2018 Tolfsson et al.
2018/0140529 A1* 5/2018 Miller, IV ..... A61K 8/66
2018/0162107 A1* 6/2018 Xu ..... B32B 27/283
2018/0327973 A1 11/2018 Siitonen et al.
2018/0355527 A1 12/2018 Strandqvist et al.
2019/0161915 A1 5/2019 Swails et al.
2020/0190739 A1* 6/2020 Qin ..... D21H 15/10
2020/0370246 A1* 11/2020 Calewarts ..... D04H 1/5412

FOREIGN PATENT DOCUMENTS

AT 519423 A3 8/2018
AU 281485 B 2/1965
AU 1973057198 A 1/1975
AU 700394 B2 1/1999
AU 721197 B2 6/2000
AU 2002300959 A 6/2003
AU 2001285005 B2 2/2006
AU 2007272602 A1 1/2008
AU 2012298266 B2 6/2016
BE 436451 A 9/1939
CA 949706 A 6/1974
CA 979699 A 12/1975
CA 2194176 A1 12/1996
CA 2868935 A1 9/2014
CA 2998561 A1 3/2018
CA 3044228 A1 * 5/2018 ..... A61K 8/922
CN 1173122 A 2/1998
CN 1260977 A 7/2000
CN 1270648 A 10/2000
CN 1364182 A 8/2002
CN 1094542 C 11/2002
CN 1518423 A 8/2004
CN 1529651 A 9/2004
CN 101300383 A 11/2008
CN 101443240 A 5/2009
CN 101453972 A 6/2009
CN 103068567 A 4/2013
CN 101410078 B 2/2014
CN 205000573 U 1/2016
CN 103993498 B 3/2016
CN 105828763 A 8/2016
CN 105828764 A 8/2016
CN 105899173 A 8/2016
CN 104302834 B 11/2016
CN 106456416 A 2/2017
CN 106988022 A 7/2017
CN 107460764 A 12/2017
CN 107988838 A 5/2018
CN 109937027 A 6/2019
DE 2041406 A1 4/1971
DE 2438587 A1 3/1975
DE 2902255 A1 7/1980
DE 3307736 A1 9/1984
DE 3420195 C2 6/1987
DE 4207233 A1 11/1993
EP 0101319 A3 3/1984
EP 3049944 B1 11/1984
EP 0264676 A1 4/1988
EP 0136329 A4 1/1989
EP 0158938 B1 12/1989
EP 0296242 A4 7/1991
EP 0443082 A1 8/1991
EP 0242361 B1 9/1991
EP 0512819 A1 11/1992
EP 0150777 B2 11/1994
EP 0481745 B1 7/1996
EP 0537005 B1 7/1997
EP 0671504 B1 8/1997
EP 0742858 B1 6/1999
EP 0951603 B1 8/2002
EP 1007784 B1 2/2003
EP 1145695 A3 1/2004
EP 1194644 B1 3/2004
EP 1457590 A1 * 9/2004 ..... D01F 6/34
EP 1400224 B1 3/2006

(56) References Cited

FOREIGN PATENT DOCUMENTS

| | | | | |
|---|---|---|---|---|
| EP | 1384457 | B1 | 5/2006 | |
| EP | 1808116 | A1 | 7/2007 | |
| EP | 1649094 | B1 | 9/2007 | |
| EP | 1442173 | B1 | 3/2008 | |
| EP | 1583865 | B1 | 5/2008 | |
| EP | 1463432 | B1 | 8/2008 | |
| EP | 1576233 | B1 | 10/2008 | |
| EP | 1813237 | A3 | 12/2008 | |
| EP | 1932968 | B1 | 9/2009 | |
| EP | 1967626 | A4 | 9/2009 | |
| EP | 1666240 | B1 | 3/2011 | |
| EP | 1440195 | B1 | 8/2011 | |
| EP | 1812637 | B1 | 1/2012 | |
| EP | 1950343 | B1 | 4/2012 | |
| EP | 1456472 | B2 | 5/2012 | |
| EP | 1497489 | B1 | 8/2012 | |
| EP | 1808152 | B1 | 8/2012 | |
| EP | 1567718 | B1 | 4/2013 | |
| EP | 2599915 | A1 | 6/2013 | |
| EP | 1268937 | B1 | 2/2014 | |
| EP | 2540892 | B1 | 4/2014 | |
| EP | 1876291 | B1 | 9/2014 | |
| EP | 2843130 | A1 | 3/2015 | |
| EP | 2952164 | A1 | 12/2015 | |
| EP | 2952165 | A1 | 12/2015 | |
| EP | 2737131 | B1 | 1/2016 | |
| EP | 1916333 | B1 | 6/2016 | |
| EP | 2001662 | B1 | 6/2016 | |
| EP | 1380401 | B1 | 7/2016 | |
| EP | 2807212 | B1 | 4/2017 | |
| EP | 2940210 | B1 | 8/2017 | |
| EP | 2622132 | B1 | 4/2018 | |
| EP | 3327395 | A1 | 5/2018 | |
| EP | 3162956 | B1 | 3/2019 | |
| EP | 3108060 | B1 | 4/2021 | |
| ES | 385106 | A1 | 3/1973 | |
| ES | 8606100 | A1 | 4/1986 | |
| ES | 2362723 | T3 | 7/2011 | |
| FI | 812601 | A | 2/1982 | |
| FI | 843904 | A | 10/1984 | |
| FI | 83741 | C | 12/1992 | |
| FI | 112812 | B | 1/2004 | |
| FI | 127377 | B | 4/2018 | |
| FI | 128917 | B | 3/2021 | |
| FR | 873763 | A | 7/1942 | |
| FR | 1449737 | A | 8/1966 | |
| FR | 1528992 | A | 6/1968 | |
| FR | 2206398 | B3 | 9/1976 | |
| GB | 1145484 | A | 3/1969 | |
| GB | 2109023 | A | 5/1983 | |
| GB | 2136813 | A | 9/1984 | |
| GB | 2116882 | B | 10/1985 | |
| GB | 2582508 | A * | 9/2020 | ..... D21F 11/002 |
| IN | 1182DEL2005 | A | 1/2007 | |
| IN | 231170 | B | 3/2009 | |
| IN | 2957KOLNP2014 | A | 5/2015 | |
| IN | 3108MUM2014 | A | 4/2016 | |
| IN | 283291 | B | 5/2017 | |
| IN | 201717030330 | A | 12/2017 | |
| IN | 201837033267 | A | 10/2018 | |
| JP | 1983115199 | A | 7/1983 | |
| JP | 1989501859 | A | 6/1989 | |
| JP | 1993140886 | A | 6/1993 | |
| JP | 4817935 | B2 | 11/2011 | |
| KR | 1020040088545 | A | 10/2004 | |
| KR | 100450272 | B1 | 12/2005 | |
| KR | 100637646 | B1 | 10/2006 | |
| KR | 100685522 | B1 | 2/2007 | |
| KR | 100725240 | B1 | 6/2007 | |
| KR | 1020100112299 | A | 10/2010 | |
| KR | 1020130077856 | A | 7/2013 | |
| KR | 101386319 | B1 | 4/2014 | |
| KR | 1020180007337 | A | 1/2018 | |
| RU | 2393093 | C2 | 6/2010 | |
| SE | 7304825 | L | 11/1977 | |
| SE | 7304888 | L | 11/1977 | |
| SE | 412881 | B | 3/1980 | |
| SE | 1651412 | A1 | 4/2018 | |
| SE | 540719 | C2 | 10/2018 | |
| WO | 1986003505 | A1 | 6/1986 | |
| WO | 1991010416 | A1 | 7/1991 | |
| WO | 1992003283 | A1 | 3/1992 | |
| WO | 9314267 | A1 | 7/1993 | |
| WO | 1996031652 | A1 | 10/1996 | |
| WO | 2000001882 | A1 | 1/2000 | |
| WO | 0025716 | A1 | 5/2000 | |
| WO | 2000050694 | A1 | 8/2000 | |
| WO | 0112902 | A1 | 2/2001 | |
| WO | 2001068793 | A1 | 9/2001 | |
| WO | 2001083866 | A2 | 11/2001 | |
| WO | 2002055788 | A2 | 7/2002 | |
| WO | 2003069038 | A1 | 8/2003 | |
| WO | 2004025009 | A2 | 3/2004 | |
| WO | 2004112956 | A1 | 12/2004 | |
| WO | 2005060712 | A2 | 7/2005 | |
| WO | 2006052967 | A2 | 5/2006 | |
| WO | 2006094077 | A2 | 9/2006 | |
| WO | 2007074625 | A1 | 7/2007 | |
| WO | 2009006371 | A2 | 1/2009 | |
| WO | 2009060118 | A2 | 5/2009 | |
| WO | 2011104427 | A1 | 9/2011 | |
| WO | 2014068196 | A2 | 5/2014 | |
| WO | 2014080084 | A1 | 5/2014 | |
| WO | 2014205048 | A1 | 12/2014 | |
| WO | 2015083092 | A1 | 6/2015 | |
| WO | 2015112155 | A1 | 7/2015 | |
| WO | 2015173474 | A1 | 11/2015 | |
| WO | 2016050901 | A1 | 4/2016 | |
| WO | 2016051350 | A1 | 4/2016 | |
| WO | 16122477 | A1 | 8/2016 | |
| WO | 2016185398 | A1 | 11/2016 | |
| WO | 2016200299 | A1 | 12/2016 | |
| WO | 2017006216 | A1 | 1/2017 | |
| WO | 2017006241 | A1 | 1/2017 | |
| WO | 2017046751 | A1 | 3/2017 | |
| WO | 2017079169 | A1 | 5/2017 | |
| WO | 2017137879 | A1 | 8/2017 | |
| WO | 2018002815 | A1 | 1/2018 | |
| WO | 2018011667 | A1 | 1/2018 | |
| WO | 2018041355 | A1 | 3/2018 | |
| WO | 2018065668 | A1 | 4/2018 | |
| WO | 2018116223 | A1 | 6/2018 | |
| WO | 2018152082 | A1 | 8/2018 | |
| WO | 2018171913 | A1 | 9/2018 | |
| WO | 2018171914 | A1 | 9/2018 | |
| WO | WO-2018199975 | A1 * | 11/2018 | ..... D21H 21/22 |
| WO | WO-2019108172 | A1 * | 6/2019 | ..... D04H 1/559 |

OTHER PUBLICATIONS

Vinda Paper (China) Co., Ltd, "Unbreakable in Water 3-layer Thickness Facial Tissue Paper", Jun. 16, 2017, http://vinda.gmc.globalmarket.com/products/details/unbreakable-in-water-3-layer-thickness-facial-tissue-paper-10750223.html.

* cited by examiner

FIBROUS SHEET WITH IMPROVED PROPERTIES

BACKGROUND

Many tissue products, such as facial tissue, bath tissue, paper towels, industrial wipers, and the like, are produced according to a wet laid process. Wet laid webs are made by depositing an aqueous suspension of pulp fibers onto a forming fabric and then removing water from the newly-formed web. Water is typically removed from the web by mechanically pressing water out of the web that is referred to as "wet-pressing." Although wet-pressing is an effective dewatering process, during the process the tissue web is compressed causing a marked reduction in the caliper of the web and in the bulk of the web.

For most applications, however, it is desirable to provide the final product with as strength as possible without compromising other product attributes. Thus, those skilled in the art have devised various processes and techniques in order to increase the strength of wet laid webs. One process used is known as "rush transfer." During a rush transfer process, a web is transferred from a first moving fabric to a second moving fabric in which the second fabric is moving at a slower speed than the first fabric. Rush transfer processes increase the bulk, caliper, and softness of the tissue web.

As an alternative to wet-pressing processes, through-drying processes have developed in which web compression is avoided as much as possible to preserve and enhance the web. These processes provide for supporting the web on a coarse mesh fabric while heated air is passed through the web to remove moisture and dry the web.

Additional improvements in the art, however, are still needed. In particular, a need currently exists for an improved process that includes unique fibers in a tissue web for increasing the bulk, softness, strength, and absorbency of the web without having to subject the web to a rush transfer process or to a creping process.

SUMMARY

In general, the present disclosure is directed to further improvements in the art of tissue and papermaking. Through the processes and methods of the present disclosure, the properties of a tissue web, such as bulk, strength, stretch, caliper, and/or absorbency can be improved. In particular, the present disclosure is directed to a process for forming a nonwoven web, particularly a tissue web containing pulp fibers, in a foam-forming process. For example, a foam suspension of fibers can be formed and spread onto a moving porous conveyor for producing an embryonic web.

In one aspect, for instance, the present disclosure is directed to a method for producing a foam-formed multi-layered substrate that includes producing an aqueous-based foam including at least 3% by weight non-straight synthetic binder fibers, wherein the non-straight synthetic binder fibers have an average length greater than 2 mm; forming together a wet sheet layer from the aqueous-based foam and a cellulosic fiber layer, wherein the cellulosic fiber layer includes at least 60 percent by weight cellulosic fibers; and drying the combined layers to obtain the foam-formed multilayer substrate.

In another aspect, a multilayered substrate includes a first layer including at least 60 percent by weight non-straight synthetic binder fibers having an average length greater than 2 mm; and a second layer including at least 60 percent by weight cellulosic fiber, wherein the first layer is in a facing relationship with the second layer, and wherein the multi-layered substrate has a wet/dry tensile ratio of at least 60%.

In yet another aspect, a multilayered substrate includes a first layer including at least 60 percent by weight non-straight synthetic binder fibers having an average length greater than 2 mm, wherein the non-straight synthetic binder fibers have a three-dimensional curly or crimped structure and are sheath-core bi-component fibers; and a second layer including at least 60 percent by weight cellulosic fiber, wherein the first layer is in a facing relationship with the second layer, wherein the multilayered substrate has a wet/dry tensile ratio of at least 60%, and wherein the multilayered substrate exhibits higher softness and absorbency than a homogeneous fibrous substrate with the same fiber composition.

Other features and aspects of the present disclosure are discussed in greater detail below.

BRIEF DESCRIPTION OF THE DRAWINGS

The foregoing and other features and aspects of the present disclosure and the manner of attaining them will become more apparent, and the disclosure itself will be better understood by reference to the following description, appended claims and accompanying drawings, where:

Figure 1:
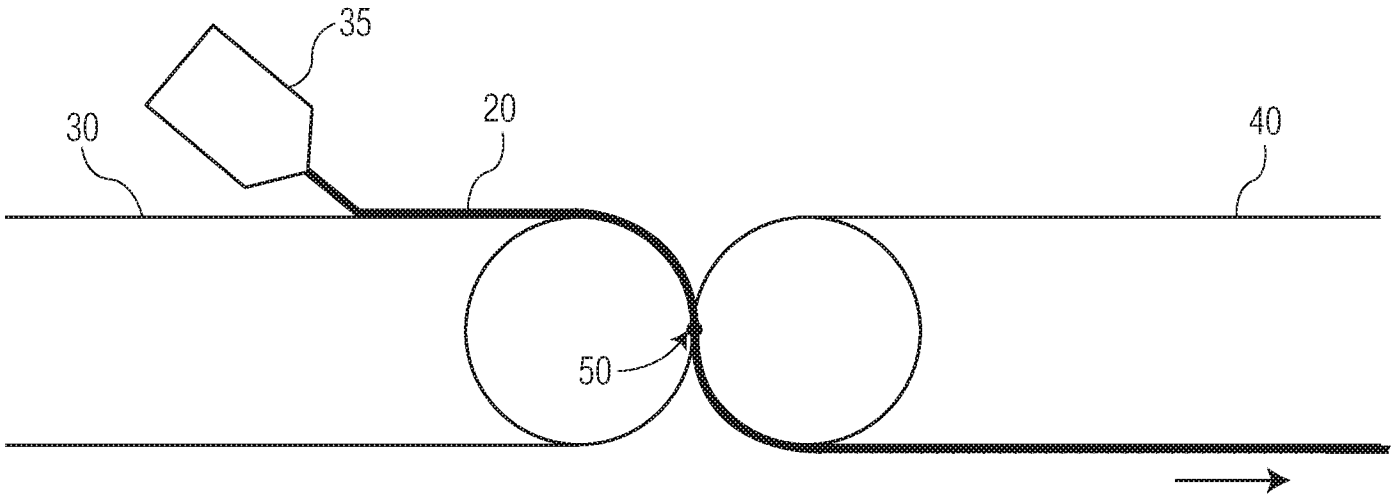
FIG. 1 is a schematic illustration of a foam-formed wet sheet being transferred from a forming wire onto a drying wire on a simplified tissue line.

Repeat use of reference characters in the present specification and drawings is intended to represent the same or analogous features or elements of the present disclosure. The drawings are representational and are not necessarily drawn to scale. Certain proportions thereof might be exaggerated, while others might be minimized.

DETAILED DESCRIPTION

It is to be understood by one of ordinary skill in the art that the present discussion is a description of exemplary aspects of the present disclosure only, and is not intended as limiting the broader aspects of the present disclosure.

In general, the present disclosure is directed to the formation of tissue or paper webs having good bulk, strength, absorbency, and softness properties. Through the process of the present disclosure, tissue webs can be formed, for instance, having better stretch properties, improved absorbency characteristics, increased caliper, and/or increased softness. In one aspect, patterned webs can also be formed. In another aspect, for instance, a tissue web is made according to the present disclosure including the use of a foamed suspension of fibers.

High wet strength is important in towel products to have enough strength to hold together during hand drying or wiping up moisture. Standard towel sheets strive to have a wet/dry tensile of about 40% to have enough wet strength to work successfully. To achieve this level of wet strength in towels, refining and wet and dry strength chemistries are used.

The foam forming process opens up the opportunity to be able to add non-traditional fibers into the tissue making process. Fibers that normally would stay bundled together in the conventional wet laid process, such as longer length synthetic fibers, are now suspended and separated individually by foam bubbles, allowing the foam forming process to offer not only the capability to make novel materials with non-standard wet-laid fibers but also basesheets with enhanced properties. Further, foam forming allows the use of non-straight synthetic binder fibers.

As used herein, "non-straight" synthetic binder fibers include synthetic binder fibers (described below) that are curved, sinusoidal, wavy, short waved, U-shaped, V-shaped where the angle is greater than 15° but less than 180°, bent, folded, crimped, crinkled, twisted, puckered, flagged, double flagged, randomly flagged, defined flagged, undefined flagged, split, double split, multi-prong tipped, double multi-prong tipped, hooked, interlocking, cone shaped, symmetrical, asymmetrical, fingered, textured, spiraled, looped, leaf-like, petal-like, or thorn-like. Long non-straight fibers have advantages described herein, but can be difficult to employ in a typical wet-laid process that usually only employs wood pulp cellulosic fiber having a fiber length less than 5 mm and typically less than 3 mm. One example of a suitable non-straight synthetic binder fiber is T-255 synthetic binder fiber available from Trevira. T-255 synthetic binder fiber is a non-straight and crimped bi-component fiber with a polyethylene terephthalate (PET) core and a polyethylene (PE) sheath.

There are many advantages and benefits to a foam-forming process as described above. During a foam-forming process, water is replaced with foam (i.e., air bubbles) as the carrier for the fibers that form the web. The foam, which represents a large quantity of air, is blended with papermaking fibers. Because less water is used to form the web, less energy is required to dry the web. For instance, drying the web in a foam-forming process can reduce energy requirements by greater than about 10%, or such as greater than about 20%, in relation to conventional wet pressing processes.

Foam-forming technology has proven its capabilities in bringing many benefits to products including improved fiber uniformity, reduced water amount in the process, reduced drying energy due to both reduced water amount and surface tension, improved capability of handling an extremely long or short fiber that enables an introduction of long staple and/or binder fibers and very short fiber fine into a regular wet laying process, and enhanced bulk/reduced density that broadens one process to be able to produce various materials from a high to a very low density to cover multiple product applications.

Bench experimentation using a high speed mixer and surfactant has produced a very low density, between 0.008 to 0.02 g/cc, foam-formed fibrous materials. Based on these results, an air-formed, 3D-structured, nonwoven-like fibrous material can be produced using a low cost but high speed wet laying process. Previous attempts to produce such low density fibrous materials using typical foam-forming lines did not produce favorable results. Both processes have equipment limitations preventing production of a low density or high bulk foam-formed fibrous material. One process lacks a drying capability and therefore must use a press with high pressure to remove water from a formed wet sheet as much as possible to gain wet sheet integrity, so the sheet can be winded onto a roll. In addition, another process does not have a pressure roll but has a continuous drying tunnel. While the latter process appears to have a potential to produce a low density fibrous material, the foam-formed wet sheet must be transferred from a forming fabric to a drying metal wire before it is dried inside the drying tunnel. Again, to gain enough wet sheet integrity for this transfer, the foam-formed sheet must be dewatered as much as possible by vacuum prior to this transfer. As a result, most of entrapped air bubbles inside the wet sheet are also removed by the vacuum, resulting in a final dried sheet with a density similar to that of a sheet produced by a normal wet laying process.

Further experimentation resulted in the discovery that an addition of non-straight synthetic binder fibers reduces the final fibrous sheet density.

Without committing to a theory, it is believed that the non-straight synthetic binder fibers in a layered structure help to achieve a high wet/dry tensile ratio. Prior art uses of crimped (non-binder) fibers had the goal of achieving high bulk. The non-straight synthetic binder fiber of the present disclosure would not work well to achieve high bulk. Whereas the prior art required a crimped (non-binder) fiber having a fiber diameter at least 4 dtex, the non-straight synthetic binder fibers of the present disclosure do not have such a requirement. For example, one of the non-straight synthetic binder fibers used in the examples described below has a fiber diameter of 2.2 dtex.

According to the present disclosure, the foam-forming process is combined with a unique fiber addition for producing webs having a desired balance of properties.

In forming tissue or paper webs in accordance with the present disclosure, in one aspect, a foam is first formed by combining water with a foaming agent. The foaming agent, for instance, can include any suitable surfactant. In one aspect, for instance, the foaming agent can include an anionic surfactant such as sodium lauryl sulfate, which is also known as sodium laureth sulfate and sodium lauryl ether sulfate. Other anionic foaming agents include sodium dodecyl sulfate or ammonium lauryl sulfate. In other aspects, the foaming agent can include any suitable cationic, non-ionic, and/or amphoteric surfactant. For instance, other foaming agents include fatty acid amines, amides, amine oxides, fatty acid quaternary compounds, polyvinyl alcohol, polyethylene glycol alkyl ether, polyoxyethylene soritan alkyl esters, glucoside alkyl ethers, cocamidopropyl hydroxysultaine, cocamidopropyl betaine, phosphatidylethanolamine, and the like.

The foaming agent is combined with water generally in an amount greater than about 0.001% by weight, such as in an amount greater than about 0.005% by weight, such as in an amount greater than about 0.01% by weight, or such as in an amount greater than about 0.05% by weight. The foaming agent can also be combined with water generally in an amount less than about 0.2% by weight, such as in an amount less than about 0.5% by weight, such as in an amount less than about 1.0% by weight, or such as in an amount less than about 5% by weight. One or more foaming agents are generally present in an amount less than about 5% by weight, such as in an amount less than about 2% by weight, such as in an amount less than about 1% by weight, or such as in an amount less than about 0.5% by weight.

Once the foaming agent and water are combined, the mixture is combined with non-straight synthetic binder fibers. In general, any non-straight synthetic binder fibers capable of making a tissue or paper web or other similar type of nonwoven in accordance with the present disclosure can be used.

A binder fiber can be used in the foam formed fibrous structure of this disclosure. A binder fiber can be either a thermoplastic bicomponent fiber, such as PE/PET core/sheath fiber, or a water sensitive polymer fiber, such as polyvinyl alcohol fiber. Commercial binder fiber is usually a bicomponent thermoplastic fiber with two different melting polymers. Two polymers used in this bicomponent fiber usually have quite different melting points. For example, a PE/PET bicomponent fiber has a melting point of 120° C. for PE and a melting point of 260° C. for PET. When this bicomponent fiber is use as a binder fiber, a foam-formed fibrous structure including the PE/PET fiber can be stabilized by exposure to a heat treatment at a temperature slightly above 120° C. so that the PE fiber portion will melt and form inter-fiber bonds with other fibers while the PET fiber portion deliver its mechanical strength to maintain the fiber network intact. The bicomponent fiber can have different shapes with its two polymer components, such as, side-side, core-sheath, eccentric core-sheath, islands in a sea, etc. The core-sheath structure is the most commonly used in commercial binder fiber applications. Commercial binder fibers include T-255 binder fiber with a 6 or 12 mm fiber length and a 2.2 dtex fiber diameter from Trevira or WL Adhesion C binder fiber with a 4 mm fiber length and a 1.7 dtex fiber diameter from FiberVisions. The threshold amount of binder fiber to be added is generally dependent on the minimum that percolation theory would predict will provide a fiber network. For example, the percolation threshold is around 3% (by mass) for 6 mm, 2.2 dtex, T-255 fibers.

Once the foaming agent, water, and fibers are combined, the mixture is blended or otherwise subjected to forces capable of forming a foam. A foam generally refers to a porous matrix, which is an aggregate of hollow cells or bubbles that can be interconnected to form channels or capillaries.

The foam density can vary depending upon the particular application and various factors including the fiber furnish used. In one aspect, for instance, the foam density of the foam can be greater than about 200 g/L, such as greater than about 250 g/L, or such as greater than about 300 g/L. The foam density is generally less than about 600 g/L, such as less than about 500 g/L, such as less than about 400 g/L, or such as less than about 350 g/L. In one aspect, for instance, a lower density foam is used having a foam density of generally less than about 350 g/L, such as less than about 340 g/L, or such as less than about 330 g/L. The foam will generally have an air content of greater than about 40%, such as greater than about 50%, or such as greater than about 60%. The air content is generally less than about 80% by volume, such as less than about 75% by volume, or such as less than about 70% by volume.

To form the web, the foam is combined with a selected fiber furnish in conjunction with any auxiliary agents. The foam can be formed by any suitable method, including that described in co-pending U.S. Provisional Patent Application Ser. No. 62/437,974.

In general, any process capable of forming a paper web can also be utilized in the present disclosure. For example, a papermaking process of the present disclosure can utilize creping, double creping, embossing, air pressing, creped through-air drying, uncreped through-air drying, coform, hydroentangling, as well as other steps known in the art.

A standard process includes a foam-forming line that is designed to handle long staple fiber and is capable of achieving very uniform fiber mixing with other components. It is not, however, designed for producing high bulk fibrous material due to its equipment limitations as discussed above. FIG. 1 illustrates a simplified tissue line and demonstrates the difficulty in using this process to produce synthetic fibrous material, where a sheet is transferred between two wires. In this line, a frothed fibrous material or wet sheet 20 is formed onto a forming wire 30 by a headbox 35, where the wet sheet 20 has three layers of different compositions of fibrous materials when it is just laid onto the forming wire 30. The wet sheet 20 is then subjected to a vacuum to remove as much of water as possible so that when the wet sheet 20 travels to the end of the first forming wire 30, it gains enough integrity or strength to allow the wet sheet 20 to be transferred to a drying wire 40.

There is a contacting point 50 between the forming and drying wires 30, 40 where the wet sheet 20 is transferred from the forming wire 30 and to the drying wire 40. After the wet sheet 20 is transferred to the drying wire 40, the wet sheet 20 keeps contact with but can fall from the drying wire 40 if the wet sheet 20 does not have sufficient amount of adhesion to overcome gravity. After the transfer, the wet sheet 20 is positioned underneath the drying wire 40. The wet sheet 20 needs to be adhered to the drying wire 40 before it reaches a through-air dried (TAD) dryer or other suitable dryer (not shown). When a wet sheet 20 contains majority of cellulosic fiber, the wet sheet 20 has a water absorption capability to keep water sufficient enough so that the wet sheet 20 adheres to the drying wire 40 without being fallen off the drying wire 40 by gravity. When a wet sheet 20 contains too much synthetic fiber, such as greater than 30%, the wet sheet 20 starts to fall or separate off the drying wire 40 due to gravity. In this method, the wet sheet 20 when containing more than 30% synthetic fiber did not have sufficient adhesion to keep the sheet attached to the drying wire 40 shown in FIG. 1.

Therefore, current processes prevent the production of any frothed material with more than 30% synthetic fibers. As a result, a modified process or a new fibrous composition is needed to produce a foam formed sheet with a high wet/dry tensile ratio. The present disclosure addresses this shortfall by forming a layered wet sheet 20 with two outer layers including a majority of cellulosic fiber and a center layer including a majority of synthetic binder fiber. This improved method overcomes the weak wire adhesion issue and at the same time achieves several benefits. First, binder fiber can be concentrated to almost 100% in the center layer to form a fully-bonded fiber network to achieve a high strength while keep overall synthetic fiber portion below 50%, or even below 30%, such that the final tissue remains cellulosic fiber based. A non-layered structure cannot achieve this. Second, the layered structure creates a non-uniform bonding point distribution. Most of the bonds are formed within the center layer among the binder fibers themselves with only slight bonding among the cellulosic fibers located in two outer layers. This arrangement allows the tissue to exhibit a high strength, high wet/dry tensile ratio, high bulk, high absorbency, and significantly enhanced overall softness.

All tissue sheets described herein are manufactured in un-creped through-air dried (UCTAD) mode. The UCTAD process uses vacuum to transfer the wet sheet from one fabric to another, as illustrated in FIG. 1. Learnings from previous foam forming trials have shown that adding more than about 30% synthetic fiber in a homogeneous sheet affects the ability of the sheet to transfer. This is due to insufficient water in the sheet for the vacuum to work. In the present disclosure this shortcoming was solved by making a multilayered substrate with cellulosic fibers for one or more outer layers using conventional wet-laid process parameters (pulp slurry run from machine chests using standard pumps and settings), with the center layer foam formed (run from dump chests where the foam slurry of non-straight synthetic binder fiber was generated by adding surfactant and mixed). The refined cellulose outer layers, because refined fibers hold more water, hold enough water to allow the sheet to be transferred. For this disclosure, a layer with up to 80% non-straight synthetic binder fibers was foam formed for the center layer.

In various aspects of the present disclosure, a multilayered substrate can include one cellulosic fiber outer layer (by wetlaid or other process) and one foam formed synthetic binder fiber middle layer, or two cellulosic fiber outer layers (by wetlaid or other process) and one foam formed synthetic binder fiber middle layer. The one or two outer layers can also be foam formed and also contain low percentage amount of synthetic fiber if additional benefits can be obtained. Preferred aspects include at least one layer that is foam formed and includes a high percentage of synthetic binder fiber to give the multilayered substrate a high wet/dry tensile ratio. Preferred aspects also include at least one outer layer that maintains direct contact with the drying wire 40 after sheet transfer, where that at least one outer layer includes a high percentage of cellulosic fiber to have sufficient sheet-wire adhesion during processing. Other layers added to the multilayered substrate can have any combination of foam formed and wetlaid layers and can include any amount of cellulosic and/or synthetic fibers.

One or more layers of a multilayered substrate can include cellulosic fibers including those used in standard tissue making. Fibers suitable for making tissue webs include any natural and/or synthetic cellulosic fibers. Natural fibers can include, but are not limited to, nonwoody fibers such as cotton, abaca, kenaf, sabai grass, flax, esparto grass, straw, jute hemp, bagasse, milkweed floss fibers, bamboo fibers, and pineapple leaf fibers; and woody or pulp fibers such as those obtained from deciduous and coniferous trees, including softwood fibers, such as northern and southern softwood kraft fibers; and hardwood fibers, such as *eucalyptus*, maple, birch, and aspen. Pulp fibers can be prepared in high-yield or low-yield forms and can be pulped in any known method, including kraft, sulfite, high-yield pulping methods, and other known pulping methods. Fibers prepared from organosolv pulping methods can also be used.

A portion of the fibers, such as up to 50% or less by dry weight, or from about 5% to about 30% by dry weight, can be synthetic fibers. Regenerated or modified cellulose fiber types include rayon in all its varieties and other fibers derived from viscose or chemically-modified cellulose. Chemically-treated natural cellulosic fibers can be used such as mercerized pulps, chemically stiffened or crosslinked fibers, or sulfonated fibers. For good mechanical properties in using papermaking fibers, it can be desirable that the fibers be relatively undamaged and largely unrefined or only lightly refined. While recycled fibers can be used, virgin fibers are generally useful for their mechanical properties and lack of contaminants. Mercerized fibers, regenerated cellulosic fibers, cellulose produced by microbes, rayon, and other cellulosic material or cellulosic derivatives can be used. Suitable papermaking fibers can also include recycled fibers, virgin fibers, or mixes thereof. In certain aspects capable of high bulk and good compressive properties, the fibers can have a Canadian Standard Freeness of at least 200, more specifically at least 300, more specifically still at least 400, and most specifically at least 500.

Other papermaking fibers that can be used in the present disclosure include paper broke or recycled fibers and high yield fibers. High yield pulp fibers are those papermaking fibers produced by pulping processes providing a yield of about 65% or greater, more specifically about 75% or greater, and still more specifically about 75% to about 95%. Yield is the resulting amount of processed fibers expressed as a percentage of the initial wood mass. Such pulping processes include bleached chemithermomechanical pulp (BCTMP), chemithermomechanical pulp (CTMP), pressure/pressure thermomechanical pulp (PIMP), thermomechanical pulp (TMP), thermomechanical chemical pulp (TMCP), high yield sulfite pulps, and high yield kraft pulps, all of which leave the resulting fibers with high levels of lignin. High yield fibers are well known for their stiffness in both dry and wet states relative to typical chemically pulped fibers.

Other optional chemical additives can also be added to the aqueous papermaking furnish or to the formed embryonic web to impart additional benefits to the product and process. The following materials are included as examples of additional chemicals that can be applied to the web. The chemicals are included as examples and are not intended to limit the scope of the disclosure. Such chemicals can be added at any point in the papermaking process.

Additional types of chemicals that can be added to the paper web include, but are not limited to, absorbency aids usually in the form of cationic, anionic, or non-ionic surfactants, humectants and plasticizers such as low molecular weight polyethylene glycols and polyhydroxy compounds such as glycerin and propylene glycol. Materials that supply skin health benefits such as mineral oil, aloe extract, vitamin E, silicone, lotions in general, and the like can also be incorporated into the finished products.

In general, the products of the present disclosure can be used in conjunction with any known materials and chemicals that are not antagonistic to its intended use. Examples of such materials include but are not limited to odor control agents, such as odor absorbents, activated carbon fibers and particles, baby powder, baking soda, chelating agents, zeolites, perfumes or other odor-masking agents, cyclodextrin compounds, oxidizers, and the like. Superabsorbent particles can also be employed. Additional options include cationic dyes, optical brighteners, humectants, emollients, and the like.

The basis weight of tissue webs made in accordance with the present disclosure can vary depending upon the final product. For example, the process can be used to produce bath tissues, facial tissues, paper towels, industrial wipers, and the like. In general, the basis weight of the tissue products can vary from about 6 gsm to about 120 gsm, or such as from about 10 gsm to about 90 gsm. For bath tissue and facial tissues, for instance, the basis weight can range from about 10 gsm to about 40 gsm. For paper towels, on the other hand, the basis weight can range from about 25 gsm to about 80 gsm.

The tissue web bulk can also vary from about 3 cc/g to about 30 cc/g, or such as from about 5 cc/g to 15 cc/g. The sheet "bulk" is calculated as the quotient of the caliper of a dry tissue sheet, expressed in microns, divided by the dry basis weight, expressed in grams per square meter. The resulting sheet bulk is expressed in cubic centimeters per gram. More specifically, the caliper is measured as the total thickness of a stack of ten representative sheets and dividing the total thickness of the stack by ten, where each sheet within the stack is placed with the same side up. Caliper is measured in accordance with TAPPI test method T411 om-89 "Thickness (caliper) of Paper, Paperboard, and Combined Board" with Note 3 for stacked sheets. The micrometer used for carrying out T411 om-89 is an Emveco 200-A Tissue Caliper Tester available from Emveco, Inc., Newberg, Oreg. The micrometer has a load of 2.00 kilo-Pascals (132 grams per square inch), a pressure foot area of 2500 square millimeters, a pressure foot diameter of 56.42 millimeters, a dwell time of 3 seconds and a lowering rate of 0.8 millimeters per second.

In multiple ply products, the basis weight of each tissue web present in the product can also vary. In general, the total basis weight of a multiple ply product will generally be the same as indicated above, such as from about 15 gsm to about 120 gsm. Thus, the basis weight of each ply can be from about 10 gsm to about 60 gsm, or such as from about 20 gsm to about 40 gsm.

EXAMPLES

For the present disclosure, basesheets were made using a standard three-layered headbox. This headbox structure allows both layered and homogeneous (all fibers types mixed together throughout the sheet) structures to be produced. Both sheet structures were made to support this disclosure.

Examples for the present disclosure include a layered sheet with 100% cellulose for the outer layers using conventional wet-laid process parameters (pulp slurry run from machine chests using standard pumps and settings). The center layer was foam formed, run from dump chests where the foam slurry of 100% T-255 synthetic binder fiber was generated by adding surfactant and mixed. A layer of up to 40% synthetic fiber was foam formed for the center layer.

The different tissue codes generated for this disclosure are described in Table 1, along with the properties each tissue code demonstrated.

TABLE 1

Tissue Compositions and Properties

| Structure | | | Composition | | Tissue Properties | | | |
|---|---|---|---|---|---|---|---|---|
| | Foam | | | | Caliper | Density | Dry | Wet/dry |
| Code | Layered | formed | Outer layers | Middle layer | (mil) | (g/cc) | GMT | GMT Ratio |
| 1 | Y | Middle layer | 30% Euc | 40% T-255 6 mm | TBD | TBD | 1821 | 0.99 |
| 2 | Y | Middle layer | 40% Euc | 20% T-255 6 mm | TBD | TBD | 952 | 0.76 |
| 3 | Y | Middle layer | 45% Euc | 10% T-255 6 mm | 39.9 | 0.039 | 399 | No reading |
| 4 | N | All layers | 90% Euc, 10% T-255 6 mm | | 40.4 | 0.039 | 462 | 0.29 |
| 5 | N | All layers | 80% Euc, 20% T-255 6 mm | | 35.2 | 0.045 | 433 | 0.35 |

The basis weights were 40.5 gsm for Code 1, 42 gsm for Code 2, and 40 gsm for Codes 3-5. Euc is *eucalyptus*. Codes 2 and 5 show a direct comparison between layered and mixed substrates using the same overall fiber amounts.

GMT is geometric mean tensile strength that takes into account the machine direction (MD) tensile strength and the cross-machine direction (CD) tensile strength. For purposes herein, tensile strength can be measured using a SINTECH tensile tester using a 3-inch jaw width (sample width), a jaw span of 2 inches (gauge length), and a crosshead speed of 25.4 centimeters per minute after maintaining the sample under TAPPI conditions for 4 hours before testing. The "MD tensile strength" is the peak load per 3 inches of sample width when a sample is pulled to rupture in the machine direction. Similarly, the "CD tensile strength" represents the peak load per 3 inches of sample width when a sample is pulled to rupture in the cross-machine direction. The GMT is the square root of the product of the MD tensile strength and the CD tensile strength of the web. The "CD stretch" and the "MD stretch" are the amount of sample elongation in the cross-machine direction and the machine direction, respectively, at the point of rupture, expressed as a percent of the initial sample length.

More particularly, samples for tensile strength testing are prepared by cutting a 3 inch (76.2 mm) wide by at least 4 inches (101.6 mm) long strip in either the machine direction (MD) or cross-machine direction (CD) orientation using a JDC Precision Sample Cutter (Thwing-Albert Instrument Company, Philadelphia, Pa., Model No. JDC 3-10, Serial No. 37333). The instrument used for measuring tensile strength is an MTS Systems SINTECH Serial No. 1G/071896/116. The data acquisition software is MTS TestWorks® for Windows Ver. 4.0 (MTS Systems Corp., Eden Prairie, Minn.). The load cell is an MTS 25 Newton maximum load cell. The gauge length between jaws is 2±0.04 inches (76.2±1 mm). The jaws are operated using pneumatic action and are rubber coated. The minimum grip face width is 3 inches (76.2 mm), and the approximate height of a jaw is 0.5 inches (12.7 mm). The break sensitivity is set at 40 percent. The sample is placed in the jaws of the instrument, centered both vertically and horizontally. To adjust the initial slack, a pre-load of 1 gram (force) at the rate of 0.1 inch per minute is applied for each test run. The test is then started and ends when the force drops by 40 percent of peak. The peak load is recorded as either the "MD tensile strength" or the "CD tensile strength" of the specimen depending on the sample being tested. At least 3 representative specimens are tested for each product, taken "as is," and the arithmetic average of all individual specimen tests is either the MD or CD tensile strength for the product.

Beside the significantly-enhanced wet/dry tensile ratio demonstrated in Table 1, data also indicated that the layered UCTAD tissues listed in Table 1 exhibit improved softness and absorbency, as shown in Table 2.

The two control codes described in Table 2 consist of a homogeneous mixed fiber sheet containing 100% cellulose pulp fiber (UCTAD Bath CHF controls from January 2015-September 2016). PBS stands for Premium Bath Score and is derived from the formulation below consisting of several Sensory Panel tests performed on the tissue basesheet.

$$PBS=5*(\text{Average Fuzzy}+\text{Volume}-\text{Rigidity}-\text{Average Gritty})+25$$

The higher the PBS value, the softer the tissue is perceived to be. Table 2 demonstrates that layered structures, at the same strength, exhibit improved softness compared to homogeneous structures.

TABLE 2

Perceived Tissue Softness

| Code | Basis Weight (gsm) | GMT (gf) | PBS |
|---|---|---|---|
| 1* | 40.5 | 1272 | 64 |
| 2* | 42 | 1054 | 64 |
| Control Code A | 40 | 1100 | 46 |
| Control Code B | 40 | 1300 | 41 |

Note:

*Codes 1 and 2 are the same materials as Codes 1 and 2 in Table 1, except that Codes 1 and 2 in Table 2 have been calendered.

GMT is geometric mean tensile strength and is described above in more detail.

Codes 1 and 2 were manufactured as bath tissue. As demonstrated in Table 3, the Codes 1 and 2 bath tissue with layered structures exhibited the same or slightly better absorbency than current commercial towel products. Towel products normally have higher absorbency than bath tissue. Absorption capacity is determined using a 4 inch by 4 inch specimen that is initially weighed. The weighed specimen is then soaked in a pan of test fluid (e.g. paraffin oil or water) for three minutes. The test fluid should be at least 2 inches (5.08 cm) deep in the pan. The specimen is removed from the test fluid and allowed to drain while hanging in a "diamond" shaped position (i.e., with one corner at the lowest point). The specimen is allowed to drain for three minutes for water and for five minutes for oil. After the allotted drain time the specimen is placed in a weighing dish and weighed. The absorbency of acids or bases having a viscosity more similar to water is tested in accordance with the procedure for testing the absorption capacity for water. Absorption Capacity (g)=wet weight (g)-dry weight (g); and Specific Absorption Capacity (g/g)=Absorption Capacity (g)/dry weight (g).

TABLE 3

Absorbency Data as Specific Absorption Capacity in g/g

| Codes | Description | Specific Absorption Capacity g/g |
|---|---|---|
| BOUNTY brand towels | Commercial | 8.25 |
| BRAWNY brand towels | Commercial | 9.06 |
| VIVA brand towels | Commercial | 8.84 |
| Code 1* | CHF Layered *eucalyptus* 30%/ T-255 40%/*eucalyptus* 30% | 9.27 |
| Code 2* | CHF Layered *eucalyptus* 40%/ T-255 20%/*eucalyptus* 40% | 8.87 |

Note:
*Codes 1 and 2 are the same materials as Codes 1 and 2 in Table 1, except that Codes 1 and 2 in Table 2 have been calendered.

It should be noted that while the examples in this disclosure were produced using a foam forming process, the disclosure should not be limited to such a process. The foam forming process is employed due to its capability of handling long fiber, such as 6 mm or 12 mm binder fiber. Conversely, if a short binder fiber (e.g., 2 mm or shorter) is used, the same layered structure can be produced using a standard water-forming process.

Results

Figure 2:
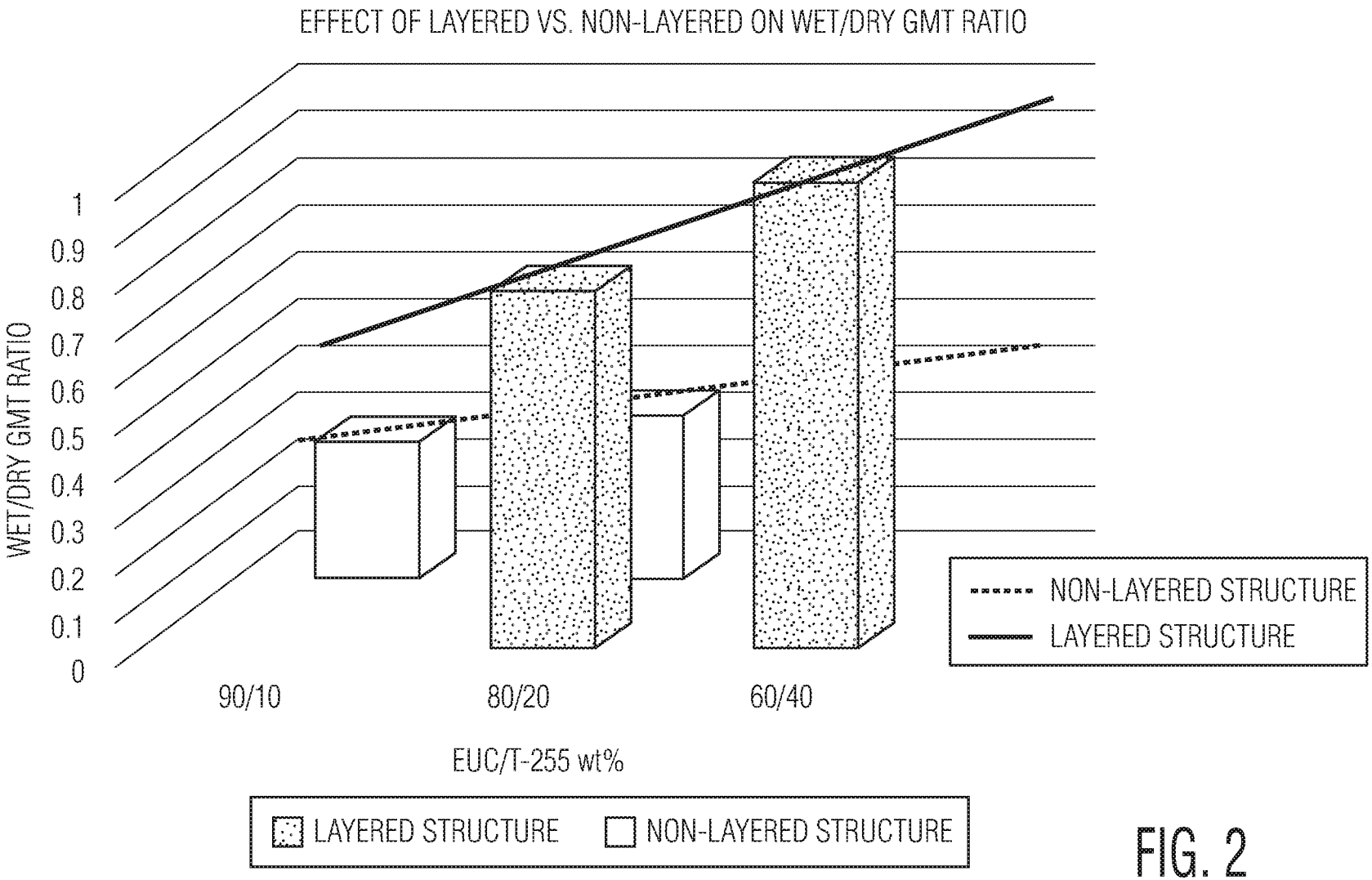
FIG. 2 is a graphic illustration comparing the effect of layered versus non-layered substrates on wet/dry geometric mean tensile (GMT) ratio.

As demonstrated in Tables 1-3, the layered structure with two cellulose fiber rich outer layers and one non-straight synthetic binder fiber rich middle layer exhibits a significant enhancement in wet/dry tensile ratio when compared to a substrate having the same fiber composition but homogenously mixed (i.e., a non-layered structure). This can be seen best in a comparison between Codes 2 and 5 in Table 1. Additional data is provided in FIG. 2, demonstrating the improvement in wet/dry tensile ratio in layered versus non-layered substrates having the same fiber compositions.

In a first particular aspect, a method for producing a foam-formed multilayered substrate includes producing an aqueous-based foam including at least 3% by weight non-straight synthetic binder fibers, wherein the non-straight synthetic binder fibers have an average length greater than 2 mm; forming together a wet sheet layer from the aqueous-based foam and a cellulosic fiber layer, wherein the cellulosic fiber layer includes at least 60 percent by weight cellulosic fibers; and drying the combined layers to obtain the foam-formed multilayer substrate.

A second particular aspect includes the first particular aspect, wherein the foam-formed layer has a dry density between 0.008 g/cc and 0.1 g/cc.

A third particular aspect includes the first and/or second aspect, wherein the non-straight synthetic binder fibers have an average length from 4 mm to 60 mm.

A fourth particular aspect includes one or more of aspects 1-3, wherein the non-straight synthetic binder fibers have an average length from 6 mm to 30 mm.

A fifth particular aspect includes one or more of aspects 1-4, wherein the non-straight synthetic binder fibers have a diameter of at least 1.5 dtex.

A sixth particular aspect includes one or more of aspects 1-5, wherein the non-straight synthetic binder fibers have a three-dimensional curly structure.

A seventh particular aspect includes one or more of aspects 1-6, wherein the non-straight synthetic binder fibers have a three-dimensional crimped structure.

An eighth particular aspect includes one or more of aspects 1-7, wherein the non-straight synthetic binder fibers are bi-component fibers.

A ninth particular aspect includes one or more of aspects 1-8, wherein the bi-component fibers are sheath-core bi-component fibers.

A tenth particular aspect includes one or more of aspects 1-9, wherein the sheath is polyethylene and the core is polyester.

An eleventh particular aspect includes one or more of aspects 1-10, wherein producing includes at least 10% by weight non-straight synthetic binder fibers.

A twelfth particular aspect includes one or more of aspects 1-11, wherein the multilayered substrate has a wet/dry tensile ratio of 60% or higher.

A thirteenth particular aspect includes one or more of aspects 1-12, wherein the cellulosic fibers are *eucalyptus* fibers.

In a fourteenth particular aspect, a multilayered substrate includes a first layer including at least 60 percent by weight non-straight synthetic binder fibers having an average length greater than 2 mm; and a second layer including at least 60 percent by weight cellulosic fiber, wherein the first layer is in a facing relationship with the second layer, and wherein the multilayered substrate has a wet/dry tensile ratio of at least 60%.

A fifteenth particular aspect includes the fourteenth particular aspect, wherein the multilayered substrate exhibits higher softness and absorbency than a homogeneous fibrous substrate with the same fiber composition.

A sixteenth particular aspect includes the fourteenth and/or fifteenth aspect, wherein the non-straight synthetic binder fibers have an average length from 6 mm to 30 mm and an average diameter of at least 1.5 dtex.

A seventeenth particular aspect includes one or more of aspects 14-16, wherein the non-straight synthetic binder fibers have a three-dimensional curly or crimped structure.

An eighteenth particular aspect includes one or more of aspects 14-17, wherein the non-straight synthetic binder fibers are sheath-core bi-component fibers.

A nineteenth particular aspect includes one or more of aspects 14-18, wherein the sheath is polyethylene and the core is polyester.

In a twentieth particular aspect, a multilayered substrate includes a first layer including at least 60 percent by weight non-straight synthetic binder fibers having an average length greater than 2 mm, wherein the non-straight synthetic binder fibers have a three-dimensional curly or crimped structure and are sheath-core bi-component fibers; and a second layer including at least 60 percent by weight cellulosic fiber, wherein the first layer is in a facing relationship with the second layer, wherein the multilayered substrate has a wet/dry tensile ratio of at least 60%, and wherein the multilayered substrate exhibits higher softness and absorbency than a homogeneous fibrous substrate with the same fiber composition.

These and other modifications and variations to the present disclosure can be practiced by those of ordinary skill in the art, without departing from the spirit and scope of the present disclosure, which is more particularly set forth in the appended claims. In addition, it should be understood that aspects of the various aspects of the present disclosure may be interchanged either in whole or in part. Furthermore, those of ordinary skill in the art will appreciate that the foregoing description is by way of example only, and is not intended to limit the disclosure so further described in such appended claims.

What is claimed is:

1. A method for producing a foam-formed multilayered substrate, the method comprising:

producing an aqueous-based foam including at least 3% by weight non-straight synthetic binder fibers, wherein the non-straight synthetic binder fibers have an average length greater than 2 mm;

forming combined layers by combining together a wet sheet layer from the aqueous-based foam and a cellulosic fiber layer, wherein the cellulosic fiber layer includes at least 60 percent by weight cellulosic fibers;

exposing the combined layers to heat such that at least a portion of the non-straight synthetic binder fibers melt to form inter-fiber bonds; and drying the combined layers to obtain the foam-formed multilayer substrate.

2. The method of claim 1, wherein the wet sheet layer from the aqueous-based foam has a dry density between 0.008 g/cc and 0.1 g/cc.

3. The method of claim 1, wherein the non-straight synthetic binder fibers have an average length from 4 mm to 60 mm.

4. The method of claim 1, wherein the non-straight synthetic binder fibers have an average length from 6 mm to 30 mm.

5. The method of claim 1, wherein the non-straight synthetic binder fibers have a diameter of at least 1.5 dtex.

6. The method of claim 1, wherein the non-straight synthetic binder fibers have a three-dimensional curly structure.

7. The method of claim 1, wherein the non-straight synthetic binder fibers have a three-dimensional crimped structure.

8. The method of claim 1, wherein the non-straight synthetic binder fibers are bi-component fibers.

9. The method of claim 8, wherein the bi-component fibers are sheath-core bi-component fibers.

10. The method of claim 9, wherein the sheath is polyethylene and the core is polyester.

11. The method of claim 1, wherein producing includes at least 10% by weight non-straight synthetic binder fibers.

12. The method of claim 11, wherein the multilayered substrate has a wet/dry tensile ratio of 60% or higher.

13. The method of claim 12, wherein the foam-formed multilayered substrate is produced in an un-creped through-air dried mode.

14. The method of claim 1, wherein the cellulosic fibers are *eucalyptus* fibers.

* * * * *